United States Patent [19]

Noda et al.

[11] Patent Number: 5,009,707

[45] Date of Patent: Apr. 23, 1991

[54] METHOD FOR MANUFACTURING AGGLOMERATES OF SINTERED PELLETS

[75] Inventors: Hidetoshi Noda; Makoto Gocho; Masayasu Shimizu; Osamu Komatsu; Hideaki Inoue, all of Tokyo, Japan

[73] Assignee: NKK Corporation, Tokyo, Japan

[21] Appl. No.: 456,800

[22] Filed: Dec. 29, 1989

[30] Foreign Application Priority Data

| | | | |
|---|---|---|---|
| Feb. 13, 1989 | [JP] | Japan | 1-33428 |
| Feb. 13, 1989 | [JP] | Japan | 1-33429 |
| Feb. 20, 1989 | [JP] | Japan | 1-39709 |

[51] Int. Cl.[5] ..... C22B 1/20

[52] U.S. Cl. ..... 75/375; 266/78; 75/755

[58] Field of Search ..... 75/375, 751, 755, 756, 75/757, 758, 759; 266/78

[56] References Cited

U.S. PATENT DOCUMENTS

| | | | |
|---|---|---|---|
| 2,878,003 | 3/1959 | Dykeman et al. | 75/383 |
| 3,149,192 | 9/1964 | Schuerger et al. | 75/375 |
| 4,149,877 | 4/1979 | Claes et al. | 75/375 |
| 4,266,966 | 5/1981 | Stirling | 75/752 |
| 4,367,091 | 1/1983 | Fujita et al. | 75/323 |

*Primary Examiner*—Melvyn J. Andrews

*Attorney, Agent, or Firm*—Fleit, Jacobson, Cohn, Price, Holman & Stern

[57] ABSTRACT

A method for manufacturing agglomerates of sintered pellets comprises the steps of mixing and pelletizing fine iron ore, flux, binder and return fines, coating pelletized materials, charging the green pellets into a sintering machine, drying charged green pellets in a drying furnace and igniting the pellets in an ignition furnace, sintering the green pellets in the sintering machine, and measuring a noise level by the use of a noise sensor arranged on a sintering bed and controlling a sintering operation on the basis of the noise level.

The noise level during igniting of the green pellets is measured by the use of noise sensors arranged on an ignition furnace and permeability of the green pellets are controlled on the basis of the noise level.

The noise level is measured by the use of plurality of noise sensors arranged in the longitudinal direction of the sintering machine followed by the ignition furnace and the burn through point is controlled on the basis of the noise level.

The noise level is measured by the use of plurality of noise sensors arranged in the direction of a width of a pallet following the ignition furnace and densities of charged materials are controlled on the basis of the measured values.

14 Claims, 5 Drawing Sheets

METHOD FOR MANUFACTURING AGGLOMERATES OF SINTERED PELLETS

BACKGROUND OF THE INVENTION

1. Field of the Invention

The present invention relates to a method for manufacturing agglomerates of sintered pellets, and more particularly to a method for controlling operations in manufacture of agglomerates of sintered pellets by the use of sensors.

2. Description of the Prior Arts

Fine iron ore, flux such as serpentine and return fines are blended and mixed by a mixer, and a mixture thereof is pelletized by a primary pelletizer. Pelletized materials made by the primary pelletizer are coated with a solid fuel and green pellets of 5 to 10 mm in particle size are manufactured. Said green pellets are charged into a grate type sintering machine and sintered. Sintered pellets are crushed into particles of predetermined size. Then, they are cooled and classified whereby agglomerates of 4 mm or more in size are manufactured.

The following control is carried out during manufacture of agglomerates of sintered pellets.

(a) A worsening of permeability of green pellets charged into a sintering machine is found through a fall of temperatures of a plurality of wind boxes on a discharge side of agglomerates and a rise of suction pressure of a main blower. Moreover, positions of a burn through point are controlled. The positions of the burn through point are determined by measuring wind box temperatures of the sintering machine and finding positions of the wind boxes having the highest temperature from a distribution of the wind box temperatures. A pallet speed is controlled so that the positions of the burn through point can be optimum positions.

(b) A difference in the wind box temperatures in a direction of a width of the wind box or a difference in a high temperature zone of an agglomerate discharge portion in a direction of a width of the layers are estimated. Densities of charged green pellets in a direction of a width of the sintering machine are controlled to make uniform a sintering speed in a direction of the width of the sintering machine on the basis of estimated differences in the direction of said widths.

In the above-mentioned method (a), the worsening of permeability of the pellets can be found only 30 to 35 minutes later after pellets of bad permeability charged into the sintering machine have passed an ignition furnace. Moreover, the reason for the worsening of the permeability is not understood if it is caused by a bursting of the green pellets or the other reasons. Since it takes much time to understand the reason for the worsening of the permeability, there occur a decrease of a productivity and lowering of quality of products.

In the case of using the difference in the wind box temperatures in the above-mentioned (b), there occur errors due to an air leakage. Therefore, only when a portion where the sintering speed is ununiform reaches the wind box on the side of the agglomerate discharge portion, the difference in the wind box temperatures in the direction of the width thereof can be detected. The difference in the high temperature zone in the direction of the width thereof can be detected only when a portion of abnormal sintering reaches the agglomerate discharge portion. That is, only 30 to 40 minutes later after the charge of the green pellets into the sintering machine, occurrence of the portion of abnormal sintering can be detected. Due to delay of a detection of the abnormal sintering, a control of the densities of the charged pellets in the direction of the width of the sintering machine delays. Accordingly, there are problems such that the productivity and the yield of agglomerates of sintered pellets lower.

SUMMARY OF THE INVENTION

It is an object of the present invention to improve a productivity, a yield and quality of agglomerates of sintered pellets.

To accomplish the above-mentioned object, the present invention provides a method for manufacturing agglomerates of sintered pellets comprising the steps of:

mixing and pelletizing fine iron ore, flux, binder and return fines;

coating pelletized materials obtained at the step of said mixing and pelletizing with powdery solid fuel, green pellets coated with powdery solid fuel being produced;

charging said green pellets into a sintering machine;

drying charged green pellets in a drying furnace and igniting said pellets in an ignition furnace;

sintering said green pellets in said sintering machine; and measuring a noise level by the use of a noise sensor arranged above a sintering bed and controlling a sintering operation on the basis of said noise level.

The above objects and other objects and advantages of the present invention will become apparent from the detailed description which follows, taken in conjunction with the appended drawings.

DESCRIPTION OF THE PREFERRED EMBODIMENT

Preferred Embodiment—1

Green pellets are rapidly heated during drying and on and occasion of igniting. When iron ore liable to be broken by heat is included into the green pellets, the green pellets burst and convert to powder due to a heat break of the iron ore and evaporation of water in the green pellets. When the green pellets often burst, permeability of a sintering bed worsens. The numbers of burstings of the green pellets are connected with a sound of burstings. The sound of burstings is measured above sintering bed. The number of burstings of the green pellets passing through the ignition furnace are detected by a sensor positioned on the ignition furnace as a level of noises. That is, since the worsening of permeability of the green pellets due to the bursting of the green pellets is detected at a mement when the green pellets pass through the ignition furnace, a prompt operation action can be taken.

Figure 1:
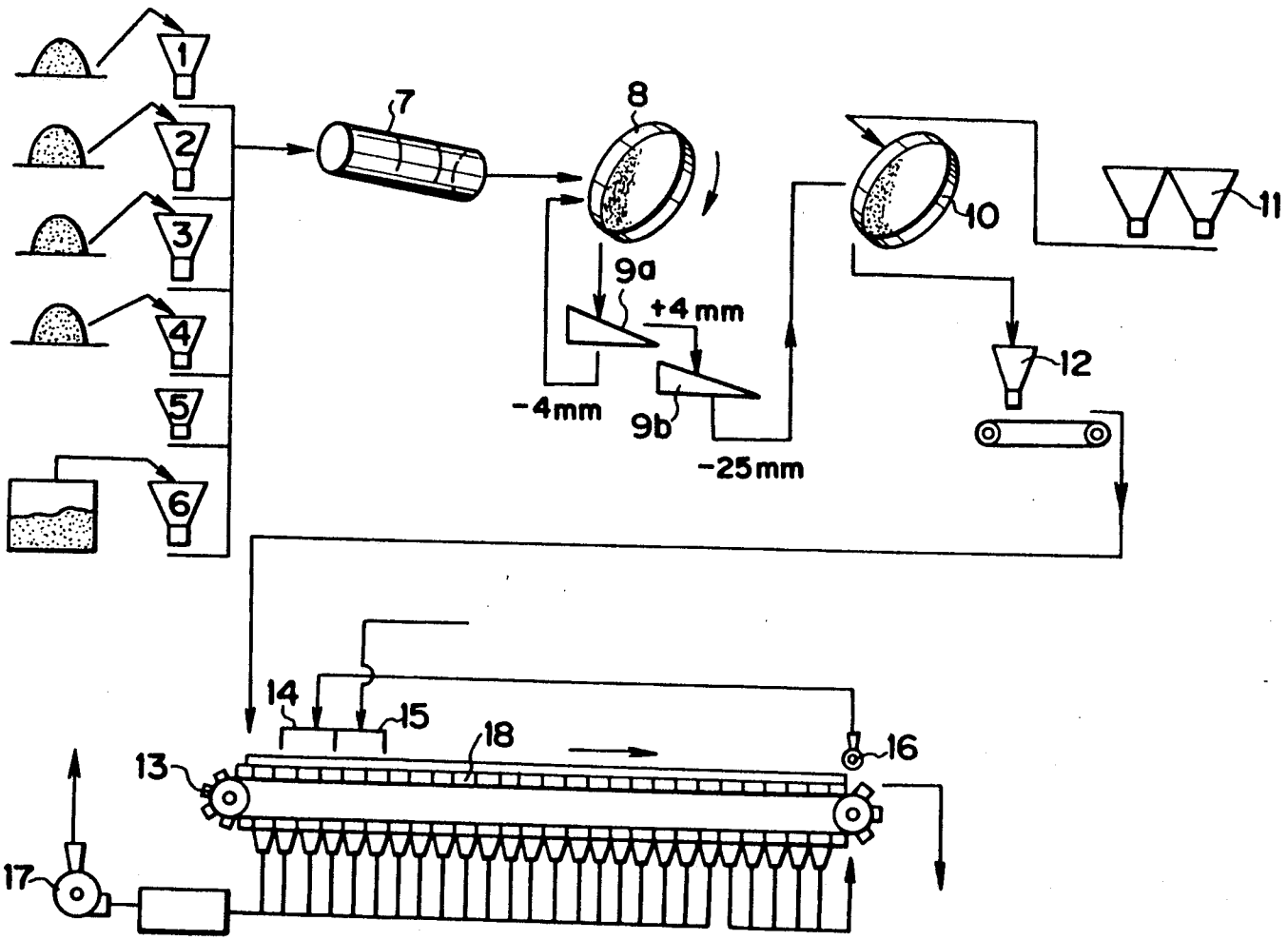
FIG. 1 is an explanatory view illustrating the steps from bins to a sintering machine.

FIG. 1 is an explanatory view illustrating the steps from a bin to a sintering machine. Coarse particle iron ore in bins 1 and 2, fine pellet feed in bin 3, serpentine as flux in bin 4, return fines of less than 4 mm in particle size in bin 5 and burnt lime as a binder in bin 6 are cut in a predetermined quantity. Water is added to them. And they are mixed. Return fines are produced during crushing and classifying of agglomerates of sintered pellets. A mixture obtained by mixing the above-mentioned materials is primarily pelletized by the use of a primary disk pelletized 8, water being added to the mixture. Primary agglomerates pelletized by the primary disk pelletizer 8 are sieved with screen 9*a* of 4 mm in mesh. The agglomerates of less than 4 mm in particle size having been sieved are returned to the primary disk pelletizer 8 and repeatedly pelletized. The agglomerates of 4 mm or more in particle size are sieved with screen 9*b* of 25 mm in mesh. Agglogmerates of less than 25 mm in particle size are charged into secondary disk pelletizer 10. Solid fuel in bin 11 is added to the secondary disk pelletizer and primary agglomerates are coated with the solid fuel whereby green pellets of 5 to 10 mm in particle size are manufactured. Powdery coak, char, pulverized coal or the like is used as the solid fuel.

Obtained green pellets are charged into pallet 18 of grate type sintering machine 13 through primary hopper 12. The green pellets are charged into the pallet 18 by means of a belt conveyer (not shown). Charged green pellets are cut off to be a predetermined uniform height. After the green pellets having a predetermined uniform height have been dried in the drying furnace 14, the surface of the green pellets is ignited in ignition furnace 15. High-temperature exhaust gas out of the wind box on the side of the agglomerate discharge portion of the sintering machine is used in the drying furnace 14. Said high-temperature exhaust gas is sent to the drying furnace 14 by means of circulation fan 16. In the sintering machine following the drying furnace 14, gas or air is sucked downward by main blower 17 through the surface of the green pellets charged into the pallet 18. A combustion zone produced on the surface of green pellets layer moves downward with movement of the pallet. The green pellets layer is sintered in the whole height of the layer just before the agglomerates discharge portion of the sintering machine and discharged continuously from the agglomerates discharged portion. Discharged agglomerates are sent to crushing and classifying steps.

Figure 2:
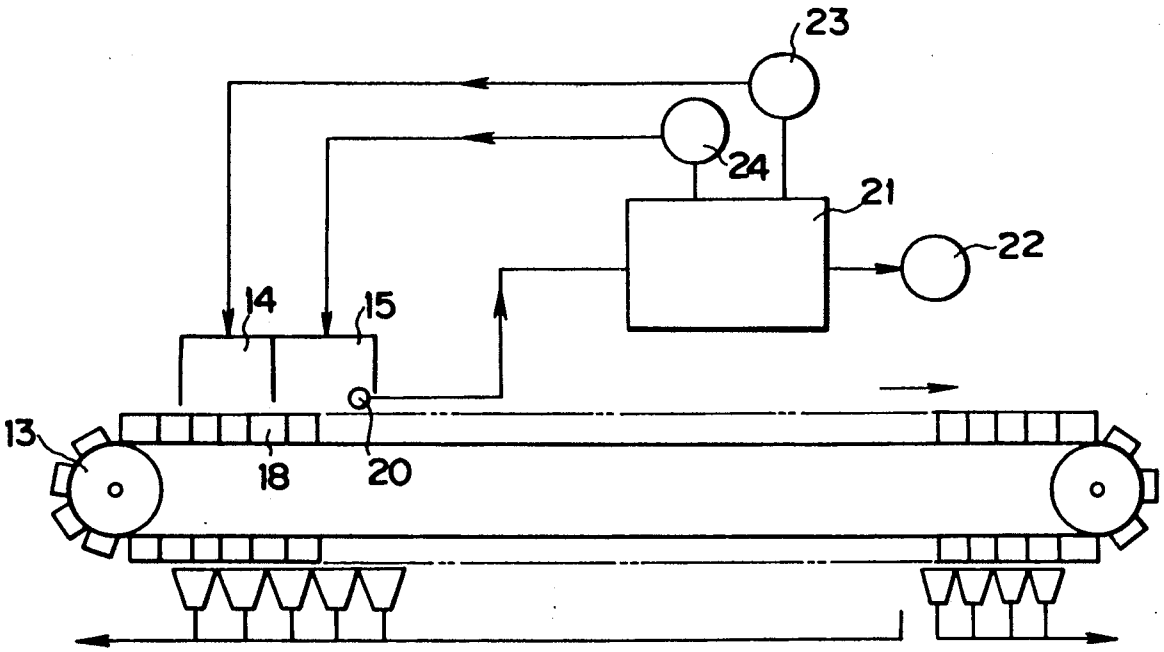
FIG. 2 is a block diagram showing a control of a sintering opration by the use of a noise sensor arranged on an ignition furnace of the present invention.

FIG. 2 is a block diagram showing a control of a sintering operation by the use of a noise sensor arranged on an ignition furnace of the present invention. Noise sensor 20 are mounted on the ignition furnace 15. Levels of noises generated on the occasion of igniting the green pellets are detected by the noise sensor 20. The sintering operation is controlled on the basis of the levels of noises. The sintering operation is controlled by an amount of binder added to agglomerates at the steps of mixing and pelletizing and temperatures in the drying furnace and in the ignition furnace. When a noise level exceeds a predetermined value, at least one action selected from the group of an increase of the amount of added binder, a rise of temperatures in the drying furnace 14 and a fall of temperatures in the ignition furnace 15 is taken.

The noise sensor 20 is mounted on a sound tube penetrated into a wall of the ignition furnace. The noise sensor can be positioned in a void portion, through which noises inside the ignition furnace escape. A signal of measured value obtained by measurement of noises with the use of the noise sensor 20 is sent to processing unit 21. Predetermined noise level values, action order and action amount which carry out the operation action are inputted into the processing unit 21. To take action or not and what action to take are decided on the basis of the measured value. When a noise exceeds a predetermined noise level, for example, firstly, the amount of added burnt lime is increased. When the noise level does not lower for a predetermined period of time after burnt lime has been added, an action to raise the temperatures inside the drying furnace is taken. When the noise level does not lower even though the above-mentioned actions are taken, an action to lower the temperatures inside the ignition furnace is taken. The amount of added burnt lime is controlled by controller 22, the temperatures inside the drying furnace by controller 23 and the temperatures inside the ignition furnace by controller 22.

In Preferred Embodiment—1, the operation action can be taken by 1 to 2 hours earlier than in the prior art method. In consequence, the productivity and quality of products can be prevented from lowering.

Preferred Embodiment—2

Figure 3:
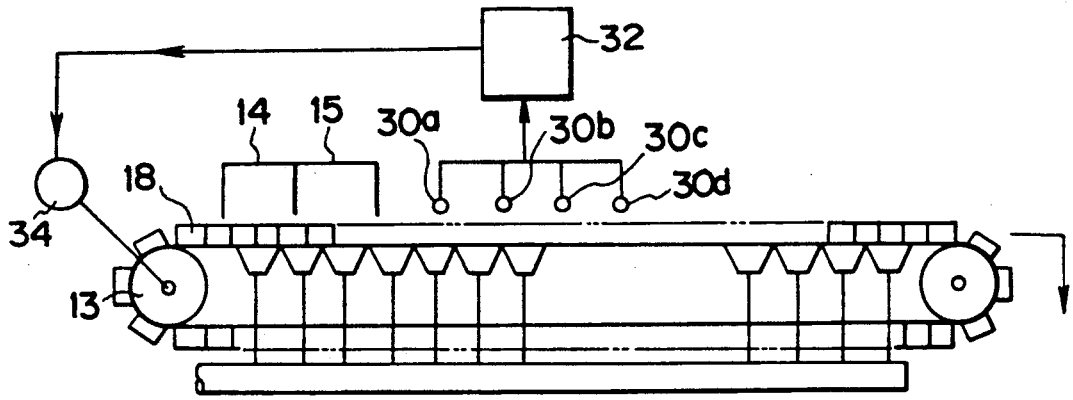
FIG. 3 is a block diagram showingg a control of a sintering operation by the use of noise sensors arranged in the longitudinal direction of the sintering machine of the present invention.

Preferred Embodiment—2 will be described with specific reference to the appended drawings. FIG. 3 is a block diagram indicating a control of a sintering operation by the use of noise sensors arranged in the longitudinal direction of a sintering machine of the present invention. Green pellets manufactured in such a manner as shown in FIG. 1 are charged into pallet 18 of a grate type sintering machine 13. After the green pellets charged into the pallet 18 have been dried in drying furnace 14, the surface of the green pellets are ignited by ignition furnace 15. In a sintering machine following the drying furnace 14, gas or air is sucked downward by a main blower through the surface of a layer of the green pellets charged into the pallet 18. A combustion zone produced on the surface of the layer of the green pellets moves downdard with movement of the pallet. The green pellets layers is sintered in the direction of a height of the green pellets layer just before an agglomerates discharge portion of the sintering machine and discharged continuously from the agglomerates discharge portion. Discharged agglomerates are sent to crushing and classiffying steps.

Green pellets containing iron ore liable to be broken by heat burst due to a break of the iron ore by heat and evaporation of water contained in the green pellets and produce a bursting sound. When a noise level of the bursting sound is measured above a sintering bed, it is understood that the noise level lowers with the movement of the combustion zone downward along the green pellets layer. Since the bursting sound of the green pellets has a specific frequency zone, accuracy of measurement of the bursting sound is enhanced when the noise level is measured by means of a band pass filter of this zone.

Figure 4:
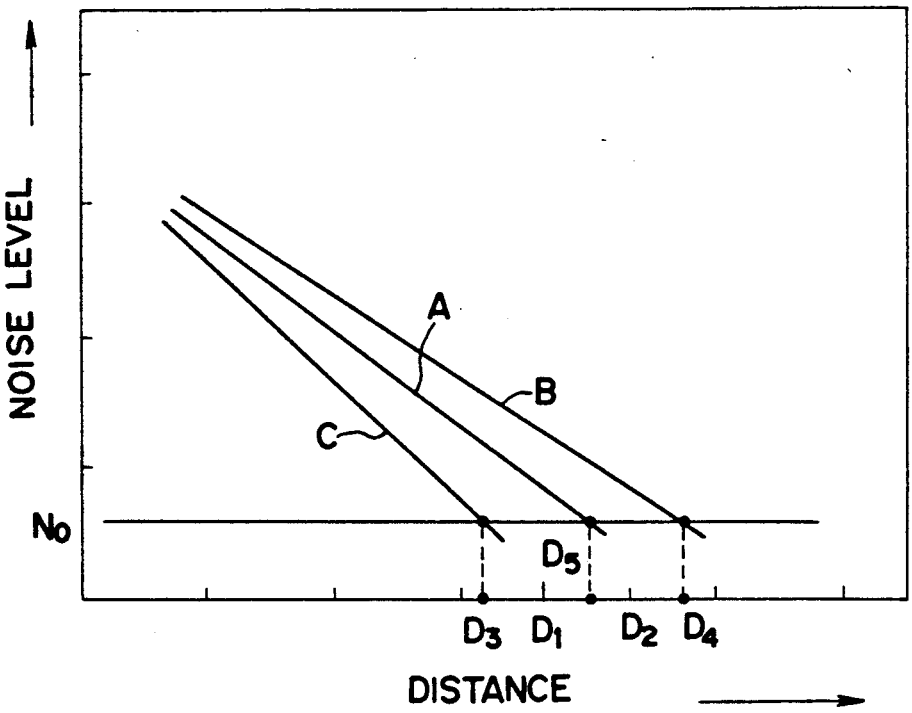
FIG. 4 is a graphical representation showing a control of positions of a burn through point of the present invention.

A plurality of noise sensors 30a, 30b, 30c and 30d are arranged at an equal interval on the upper side of a sintering bed following the ignition furnace in the longitudinal direction of the sintering machine. Said interval is desired to be about 2 m. The noise sensors are positioned 5 to 10 cm above a sintering bed. A signal of the noise level measured by the noise sensors 30a, 30b, 30c and 30d is sent to arithmetic and control unit 32. A damping straight line of the noise level can be found by representing positions of the noise sensors 30a, 30b, 30c and 30d in the longitudinal direction of the sintering machine with the axis of abscissa and the noise level with the axis of ordinate and by making an approximate straight line. A burn through point can be found by a point of intersection where a straight line indicating the predetermined noise level No at the burn through point, namely, y=No crosses said damping straight line. FIG. 4 is a graphical representation showing a method for controlling positions of the burn through point of the present invention. When a found damping straight line of the noise level is B as shown in FIG. 4, distance $D_4$ can be obtained from a point of intersection where said damping straight line crosses a straight line indicating the noise level No at the burn through point, namely y=No. The distance $D_4$ is the burn through point and is represented with a distance from an rear end of the ignition furnace. It is confirmed where $D_4$ is relative to a range of an optimum burn through point. In case the burn through point is in the position of the distance $D_4$, since the burn through point is positioned on the side of the agglomerates discharge portion rather than the optimum range of $D_1$ to $D_2$, a signal to decrease a predetermined pallet speed is outputted.

In case a found damping straight line of the noise level is A as shown in FIG. 4, distance $D_5$ is obtained from a point of intersection where the damping straight line A crosses a straight line indicating noise level No at the burn through point, namely, y=No. Distance $D_5$ is the burn through point and is represented with distance from a rear end of the ignition furnace. In case the burn through point is positioned at $D_5$, since the burn through point is in the optimum range of $D_1$ to $D_2$, signals of increase and decrease of the pallet speed are not outputted.

When a found damping straight line of the noise level is C as shown in FIG. 4, the distance of the burn through point is $D_3$. Since $D_3$ is positioned on the side of the ignition furnace rather than in the optimum range of $D_1$ to $D_2$, signals to increase a pallet speed to a predetermined speed are outputted.

The pallet speed is increased and decreased as follows:

(a) A relational expression of a position of the burn through point relative to the increase or decrease of the pallet speed is found in advance.

(b) An amount of movement of the burn through point is found so that the burn through point can be in the range of $D_1$ to $D_2$.

(c) The increase and decrease of the pallet speed is found by putting the amount of movement of the burn through point into the above-mentioned expression.

Signals of the increase and decrease of the pallet speed which are found in such a way as described above are sent to drive motor 34 of the sintering machine by means of artithmetic and control unit 32. The pallet speed is increased or decreased by the drive motor 34. Accordingly, the burn through point is always controlled so that it can be within the optimum range.

Noise sensors 30a, 30b, 30c and 30d are desired to be arranged 5 to 10 m from the rear end of the ignition furnace on the side of the agglomerates discharge portion. The burn through point can be detected by 15 to 20 minutes earlier than in the prior art method by arranging the noise sensors 5 to 10 m from the rear end of the ignition furnace. Accordingly, since the burn through point can be detected early and actions can be taken early, worsening of quality of products and a fall of quantity of production can be prevented.

Preferred Embodiment—3

Figure 5:
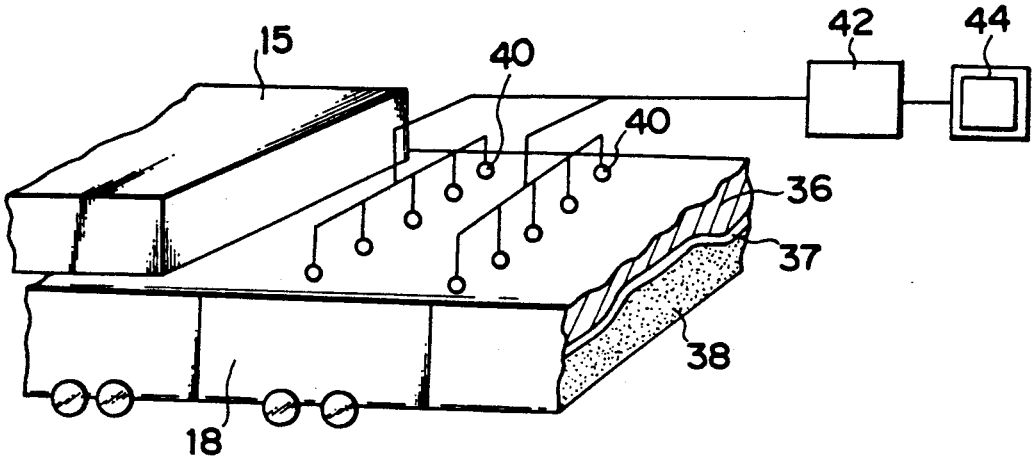
FIG. 5 is a schematic illustration indicating a method for detecting positions of a combustion zone in a direction of a width of a pallet of the sintering machine of the present invention.

FIG. 5 is a schematic illustration showing a method for detecting positions of a combustion zone in a direction of a width of a pallet of a sintering machine of the present invention. The surface of the green pellets charged into the sintering machine is ignited in the ignition furnace 15. The combustion zone produced by ignition is moved downward in a layer of green pellets by a downward suction of gas or air as the pallet 18 moves to the side of the agglomerates discharge portion. When there is a deviation of suction of air in the direction of the width of the pallet, a deviation of a speed of a downward movement of the combustion zone takes place. As clearly seen from a section of a sintering bed, there occurs a deviation of heights of the layer from the surface of the sintering bed to the combustion zone 37. In an example of FIG. 5, the height of a central portion in the direction of the width of the pallet is smaller than the height of a portion near side walls of the pallet when the height of the central portion is compared with that of the portion near side walls of the pallet. Sinter zone 36 is present in an upper portion of the combustion zone 37. Zone 38 of green pellets is present in a lower portion of the combustion zone 37. The sinter zone 36 and the zone 38 of green pellets are deviated corresponding to the deviation of the combustion zone 37.

Some of the green pellets burst in the combustion zone 37 and produce a bursting sound. A noise level of the bursting sound is measured by a noise sensor arranged on an upper surface of the sintering bed. Since the noise level damps in proportion to a depth of the combustion zone 37, positions of the combustion zone 37 in the direction of the width of the pallet can be caught when sensors are arranged at a plurality of positions in the direction of the width of the pallet.

Every five noise sensors 40 are arranged at a definite interval in the direction of the width of the pallet 45 in two rows 5 to 10 cm over the surface of the sintering bed. A distance from the noise sensor 40 to an end of the discharge side of the ignition furnace is desired to be a distance, in which a deviation of the depth of the combustion zone in the direction of the width thereof can be clearly caught. Since the bursting sound of the green pellet has a specific frequency zone, accuracy of measurement of the bursting sound is enhanced when the noise level is measured by means of a band pass filter of the specific frequency zone. For example, a frequency zone of 250 to 570 Hz is used. Signals of measurement of the noise sensor 40 are subjected to data processing by means of processing unit 42. Data having been subjected to graphic processing or display processing are represented as graphs or tables on CRT 44.

Figure 6:
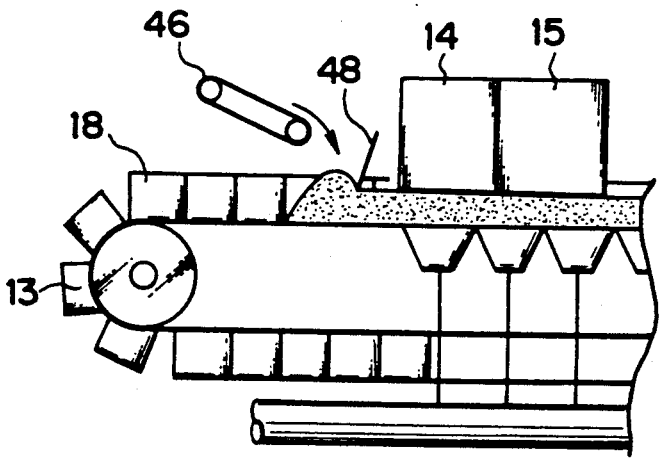
FIG. 6 is a schematic illustration designating a material charge portion of the sintering machine used for execution of the method of the present invention.

FIG. 6 is a schematic illustration showing a material charging portion of a sintering machine used for executing the method of the present invention. Green pellets are charged into pallet 18 by the use of charging belt conveyer 46. A height of charged green pellets is made uniform to have a predetermined height by the use of cut plate 48.

Figure 7:
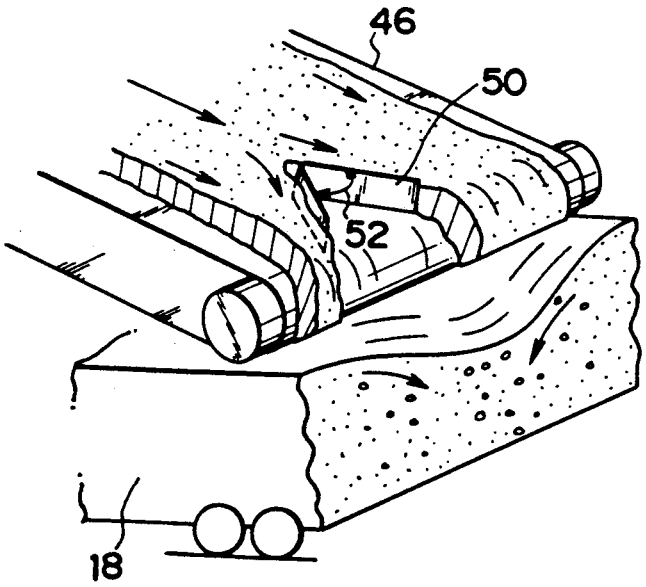
FIG. 7 is a schematic illustration showing a method for controlling densities of materials charged into the sintering machine of the present invention.

FIG. 7 is a schematic illustration showing a method for controlling densities of materials charged into a sintering machine. The densities of the materials are controlled by a height of layers of the green pellets stacked up near side walls of the pallet. An amount of the green pellets of large particle size flowing into the center of the pallet is controlled by controlling the height of the layers of green pellets. When there is a great amount of green pellets of large particle size flowing into the center of the pallet, permeability of the green pellets at the center of the pallet becomes better. Conversely, when there is a small amount of green pellets of large particle size flowing into the center of the pallet. permeability of the green pellets of large particle size becomes worse. The amount of green pellets of large particle size flowing into the center of the pallet is controlled by means of dispersing plate 50 arranged on the charging belt conveyer 46. That is, vertical angle 52 of the dispersing plate is controlled on the basis of a depth of layers of green pellets in the combustion zone 37, which is caught by the noise sensor 40, in the direction of the width of the pallet. In case positions of the combustion zone near the side walls of the pallet are deep, the densities of the materials charged into the pallet is increased by making the vertical angle of the dispersing plate 50 wide to a predetermined angle. When the densities of charged materials are increased, a sintering speed decreases. In consequence, there is no lack of heat near the side walls of the pallet and this prevents the pellets from being not sintered.

According to the present invention, densities of materials charged into a pallet in the direction of a width of the pallet can be controlled 25 to 30 minutes earlier than in the prior art method. Accordingly, since action can be taken promptly, a decrease of the yield and the productivity of agglomerates of sintered pellets can be prevented.

What is claimed is:

1. A method for manufacturing agglomerates of sintered pellets comprising the steps of:

mixing and pelletizing fine iron ore, flux, binder and return fines;

coating pelletized materials obtained in said step of the mixing and pelletizing with powdery solid fuel, thereby producing green pellets coated with powdery solid fuel;

charging said green pellets into a sintering machine;

drying said green pellets in a dry furnace on said sintering machine and igniting said green pellets in an ignition furnace;

sintering said green pellets on said sintering machine;

measuring a noise level by the use of a noise sensor placed at the ignition furnace, said noise level being indicated by means of a bursting sound produced by said green pellets when said green pellets are burst at the time of the ignition of said green pellets, and permeability of a sintering bed of the sintering machine being worsened when said noise level becomes high; and taking operation control action in response to said noise level, said operation control action improving the permeability of the sintering bed.

2. The method of claim 1, wherein said sensor is mounted on a sound tube placed inside a wall of the ignition furnace.

3. The method of claim 1, wherein said operation control action includes controlling an amount of binder at the steps of mixing and pelletizing.

4. The method of claim 1, wherein said operation control action includes controlling an infurnace temperature in a drying furnace.

5. The method of claim 1, wherein said operation control action includes controlling an infurnace temperature in an ignition furnace.

6. The method of claim 1, wherein said plurality of sensors are placed 5 to 10 cm high above a surface of a sintering bed of said sintering machine.

7. A method for manufacturing agglomerates of sintered pellets comprising the steps of:

(a) mixing and pelletizing fine iron ore, flux, binder and return fines;

(b) coating pelletized materials obtained in said step of the mixing and pelletizing with powdery solid fuel, thereby producing green pellets coated with powdery solid fuel;

(c) charging said green pellets into a sintering machine;

(d) drying said green pellets on said sintering machine and igniting said green pellets in an ignition furnace;

(e) sintering said green pellets on said sintering machine;

(f) measuring a noise level by a plurality of noise sensors placed in a longitudinal direction of the sintering machine and at a backward location relative to the ignition furnace, said noise level being indicated by means of a bursting sound produced by said green pellets when said green pellets are burst at the time of the ignition of said green pellets, and a burn through point being calculated based on said noise level in the longitudinal direction; and (g) controlling said run through point calculated based on said noise level to be within a predetermined range of said noise level.

8. The method of claim 7, wherein said burn through point calculated based on said noise level is controlled by means of a pallet speed variation.

9. The method of claim 7, wherein said plurality of sensors are placed 5 to 10 m at the back of a rear end of the ignition furnace toward a side of discharging manufactured agglomerates.

10. The method of claim 7, wherein said noise level is measured within a frequency zone of 250 to 570 Hz.

11. A method for manufacturing agglomerates of sintered pellets comprising the steps of:

(a) mixing and pelletizing fine iron ore, flux, binder and return fines;

(b) coating pelletized materials obtained in said step of the mixing and pelletizing with powdery solid fuel, thereby producing green pellets coated with powdery solid fuel;

(c) charging said green pellets into a sintering machine;

(d) drying said green pellets on said sintering machine and igniting said green pellets in an ignition furnace;

(e) sintering said green pellets on said sintering machine;

(f) measuring a noise level by a plurality of noise sensors placed in a pallet width direction and backward location of the ignition furnace, said noise level being indicated by means of a bursting sound produced by said green pellets, and permeability of a sintering bed of the sintering machine is poor in an area where said noise level is high;

(g) calculating a deviation of measured values of said noise level in the pallet width direction; and (h) controlling charging density of said charged green pellets in the pallet width direction by using the calculated deviation.

12. The method of claim 11, wherein said noise sensors are placed 5 to 10 cm above the sintering bed.

13. The method of claim 11, wherein said noise level is measured within a frequency zone of 250 to 570 Hz.

14. The method of claim 11, wherein said charging density is controlled by a dispersing plate placed on a charging belt conveyer for charging green pellets.

* * * * *